US007581548B2

(12) United States Patent
Henricksen et al.

(10) Patent No.: US 7,581,548 B2
(45) Date of Patent: Sep. 1, 2009

(54) DECORATIVE ELASTIC HAIR ACCESSORY

(76) Inventors: Douglas A. Henricksen, 929 Kingwood Cir., Highland Village, Denton County, TX (US) 75077; Sandra Lyn Wells, 25132 Tasman Rd., Laguna Hills, Orange County, CA (US) 92653

( * ) Notice: Subject to any disclaimer, the term of this patent is extended or adjusted under 35 U.S.C. 154(b) by 194 days.

(21) Appl. No.: 11/130,775

(22) Filed: May 17, 2005

(65) Prior Publication Data

US 2006/0260634 A1 Nov. 23, 2006

(51) Int. Cl.
*A45D 8/12* (2006.01)

(52) U.S. Cl. ..... 132/275

(58) Field of Classification Search ..... 132/200, 132/273, 275; D28/41; 2/171, 174
See application file for complete search history.

(56) References Cited

U.S. PATENT DOCUMENTS

| | | | | | |
|---|---|---|---|---|---|
| 537,542 | A * | 4/1895 | Moore | 132/275 |
| D292,030 | S | 9/1987 | Revson | |
| D315,036 | S | 2/1991 | Leopold | |
| D315,226 | S | 3/1991 | Revson | |
| 5,156,171 | A * | 10/1992 | Goodman | 132/200 |
| 5,293,884 | A * | 3/1994 | Chapman et al. | 132/200 |
| 5,301,696 | A | 4/1994 | Revson | |
| 5,413,126 | A | 5/1995 | Revson | |
| 5,465,741 | A * | 11/1995 | Dvorak | 132/275 |
| 5,706,836 | A | 1/1998 | McKeown | |
| 5,758,671 | A * | 6/1998 | Thim | 132/273 |
| 5,826,598 | A * | 10/1998 | Meehan | 132/275 |
| D402,082 | S | 12/1998 | Lee | |
| 6,000,408 | A * | 12/1999 | Maturaporn | 132/273 |
| 6,047,708 | A * | 4/2000 | Panel et al. | 132/273 |
| 6,182,672 | B1 | 2/2001 | Abasta-Douglas et al. | |
| 6,295,992 | B1 | 10/2001 | Sapp | |
| 6,435,194 | B1 * | 8/2002 | Babay | 132/275 |
| 6,799,581 | B2 * | 10/2004 | Cave | 132/273 |
| 7,305,996 | B2 * | 12/2007 | Kraft et al. | 132/273 |
| 2002/0056467 | A1 * | 5/2002 | Srivastava | 132/273 |

OTHER PUBLICATIONS

Sewing.org Beginner sewing lessons. http://web.archive.org/web/20040205073136/www.sewing.org/enthusiast/html/el_buttonholes2.html.*

* cited by examiner

*Primary Examiner*—Robyn Doan
*Assistant Examiner*—Rachel R Steitz
(74) *Attorney, Agent, or Firm*—Carstens & Cahoon, LLP; Vincent J. Allen

(57) ABSTRACT

A method for making and pony tail holder for securely holding the hair of a user includes a band of elastic material with fabric ring substantially surrounding the band. A portion of the band can be exposed through a pair of apertures in the fabric. The apertures are separated by a bar tack stitch. The exposed band is pulled out of the apertures in the fabric ring to form a loop in the band and concomitantly causes concentric shrinking of the fabric ring central opening. A ponytail or other object can be placed through the loop of the exposed band. The exposed band can then be twisted to form additional loops to pull the ponytail through to tighten the hold on the ponytail. The ponytail can be optionally placed through the central portion of the fabric ring and held securely in place. The fabric ring is not twisted permitting a decorative design to be displayed without obstruction.

11 Claims, 4 Drawing Sheets

DECORATIVE ELASTIC HAIR ACCESSORY

BACKGROUND OF THE INVENTION

1. Technical Field

The present invention relates to a decorative reversible pony tail holder and method for making the ponytail holder that holds the hair of a user in a tight and secure manner.

2. Description of Related Art

Elastic ponytail ties are an effective means to secure hair in ponytails or pigtails. Similarly pony tail holders with elastic bands and surrounding fabric, sometimes referred to as "scrunchies" are often used to keep one's hair neat and out of the way while simultaneously providing fashion to one's overall appearance. Such examples in the prior art include the following patents: U.S. design Pat. Nos. 292,030; 315,036; 315,226; 402,082; and U.S. Pat. Nos. 5,146,171; 5,413,126; 5,706,836; 5,758,671; 6,000,408; 6,047,708; 6,182,672; 6,295,992; 6,435,194; and 6,799,581.

A traditional scrunchie or elastic-only ponytail tie can be placed on a ponytail by pulling the ponytail through the scrunchie, twisting the scrunchie into a "figure 8" and then pulling the ponytail through the newly created opening or opposite end of the figure 8. This process can be repeated until the ponytail is securely fastened. Scrunchies, however, have a tendency to become loose and slide out of the hair and periodically need to be restraightened. Such undesirable movement can become more pronounced if a person is playing a sport, such as tennis or soccer, where rapid movement of the head in different directions can cause the scrunchie to loosen. One solution to this problem is to further tighten the scrunchie with additional twisting around the hair. One consequence of this solution is the creation of a large knot of twisted fabric. This fabric knot in the scrunchie can decrease comfort. Further, the knot can also obscure or diminish desired designs on the scrunchie.

Another prior art solution would be to first secure one's ponytail with an elastic-only (e.g. fabric less) ponytail tie and subsequently place a scrunchie over the top of the ponytail tie. This solution is undesirable, however, as it requires two separate articles which must be separately placed on the ponytail. Further, it is more difficult to keep up with separate articles because the chances of misplacing or losing one of the articles is increased. For example, the fabric can inadvertently fall off unbeknownst to the user because the ponytail would still be held in place with the elastic-only tie. Consequently, a need exists for a pony tail holder that can be securely and easily fastened to a pony tail. Further, a need exists for a pony tail holder that is reversible having decorative qualities that are not compromised when either side of the pony tail holder is securely fastened to a pony tail.

SUMMARY OF THE INVENTION

According to the present invention, a pony tail holder and method for making such holder comprises an elastic band with fabric surrounding the band. A portion of the band is exposed through a pair of apertures at the inner seam or fold. A user can easily access and subsequently pull on the exposed band, form a first loop, place a length of hair through the first loop, twist the exposed band to form a second loop, and pull the ponytail through the second loop. The exposed band can be twisted as much as desired by the user. The length of hair can then optionally be inserted through the fabric opening. In one aspect, a first design can be placed on a first side of the fabric and a second design can be placed on the second side of the fabric. As the fabric is not twisted, only the first side of the fabric becomes the display side and is oriented outwardly and the second side of the fabric faces the users head. A pair of apertures are placed on opposite sides of an inner fold or inner seam. A bar tack stitch between the apertures keeps the exposed band exposed and permits easy access to the exposed band by a user. The strategic placement of the apertures permits the pony tail holder to be reversed such that the second side of the fabric can face outward and the first side of the fabric can face the users head. The above as well as additional features and advantages will become apparent in the following written detailed description.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings wherein:

DETAILED DESCRIPTION

Figure 1A:
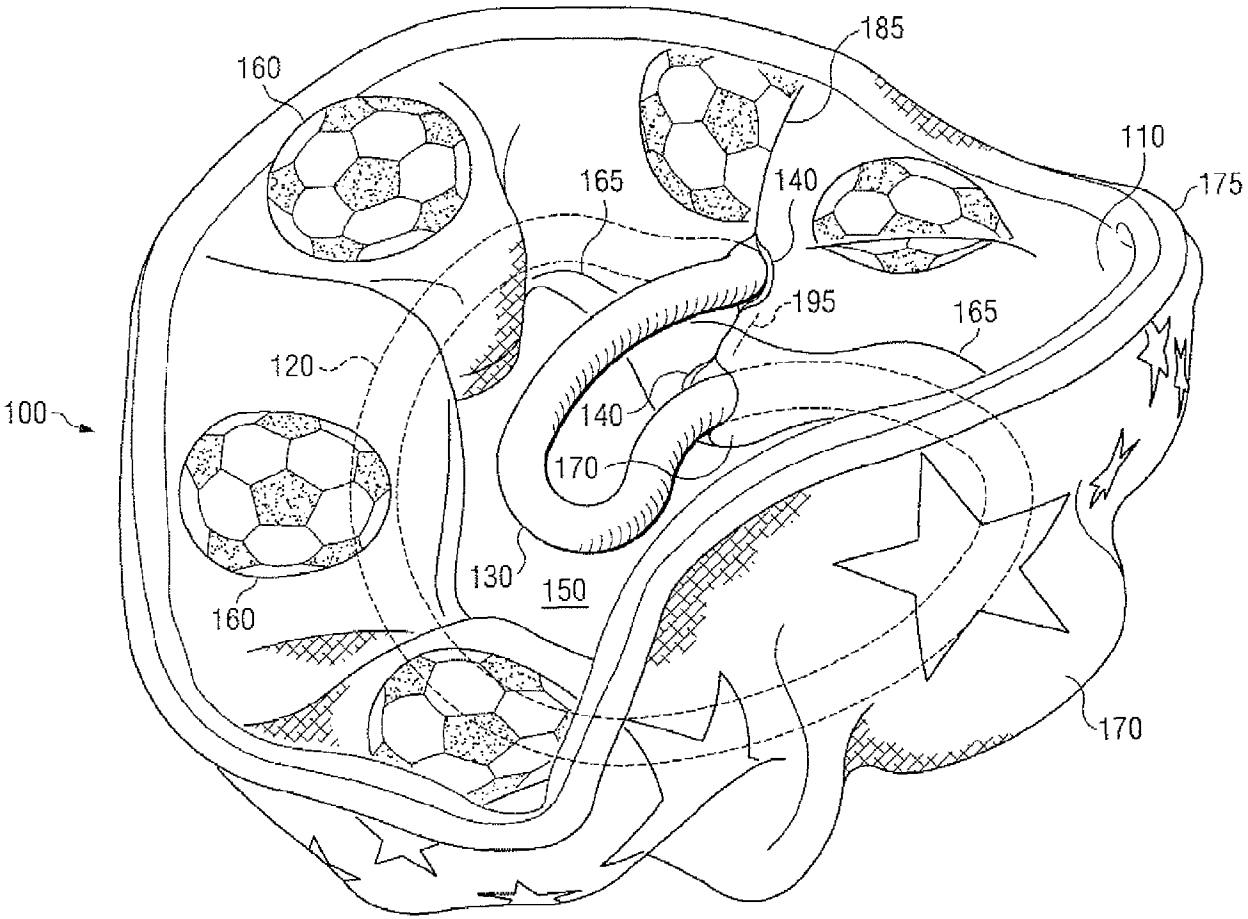
FIG. 1*a* is a perspective view of one embodiment of the hair accessory of the present invention.

FIG. 1*a* is a perspective view of one embodiment of the hair accessory of the present invention. The hair accessory, scrunchie, or pony tail holder 100 comprises a fabric ring 110 substantially surrounding an elastic band 120, shown partly in phantom. The term "substantially surrounding" is used because a protruding portion 130 of the elastic band 120 occurs in an area having a pair of apertures 140 in the fabric ring 110. As such, the protruding portion 130 of the elastic band 120 is not surrounded by the fabric ring 110. A bar tack stitch 195 intersects the intersecting seam 185, equally distributing the bar tack stitch 195 on each side of the inner seam or inner fold 165. In one embodiment, the fabric ring 110 has a central opening 150 sized to receive a pony tail. In the embodiment shown, the fabric ring 110 comprises a joined fabric further comprised of a first side made from a first piece of fabric having a first design 160 and a second side made from a second piece of fabric having a second design 170. In the embodiment shown, the first design 160 is a plurality of soccer balls and the second design 170 is a plurality of stars.

Figure 1B:
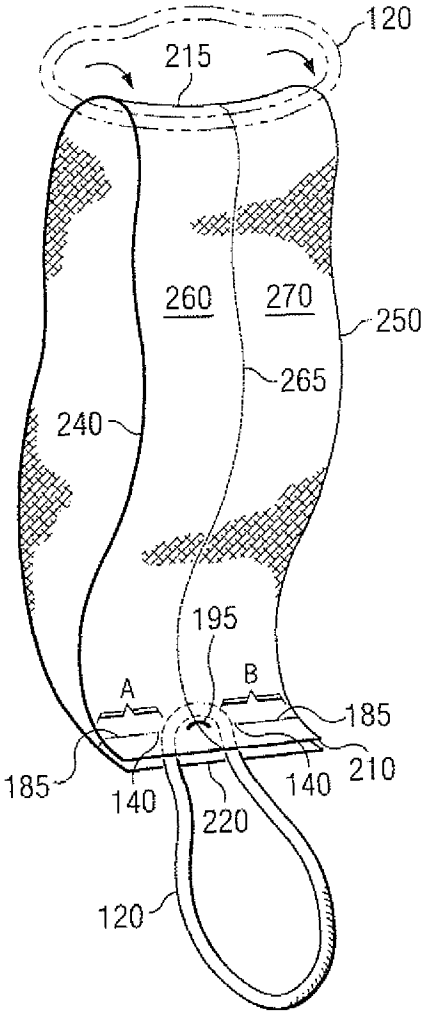
FIG. 1*b* illustrates the method construction of the hair accessory depicted in FIG. 1*a* in accordance with one embodiment of the present invention.

FIG. 1*b* illustrates the method construction of the hair accessory depicted in FIG. 1*a* in accordance with one embodiment of the present invention. Where used in the Figures, the same numerals designate the same or similar parts. First, if two pieces of fabric are to be used, the first piece of fabric 260 and second piece of fabric 270 are joined together to form inner seam 265 about inner circumference 165 (as shown by FIG. 1*a*) by sewing or other means to create a joined piece of fabric. If only a single piece of fabric is to be used, the previous step is omitted. Next, the piece of fabric having a first end 210 and a second end 220 is then looped through the elastic band 120 (shown in phantom). The fabric is then folded in half around the elastic band 120 to create a fold 215. A bar tack stitch 195 is then sewn for a short distance on each side of the inner seam 265 to join the first end 210 and second end 220 of the fabric. The elastic band 120 can then be pulled down to the bar tack stitch 195 (non-phantom 120). The first end 210 and second end 220 can then be further joined together by an intersecting seam 185. The intersecting seam 185 is made by sewing the first end 210 and second end 220 of fabric together. This can be accomplished by sewing a seam A, jumping the elastic band and sewing seam B to complete the intersecting seam 185. Next, an outer seam 175 (as shown in FIG. 1*a*) is formed by sewing together the first outer side 240 to the second outer side 250 (as shown in FIG. 1*b*) to encapsulate the non-protruding elastic band 120 and form the fabric ring 110 (as shown in FIG. 1*a*).

Referring to FIG. 1*a*, the apertures 140 are thereby formed by gaps between the intersecting seam 185 and bar tack stitch 195. Thus, in the embodiment shown, the pair of apertures 140 are separated by the bar tack stitch 195, and are located symmetrically on opposite sides of the inner seam 165. Because the pair of apertures 140 are symmetrically placed adjacent to the central opening 150 about the inner seam 165, either the first side (e.g. first design 160) or second side (e.g. second design 170) can be displayed equally well. There are several advantages provided by the bar tack stitch 195 of the present invention. The bar tack stitch 195 permits even distribution of the elastic ponytail band between the two apertures 140. This even distribution means that neither the first side nor second side is favored and either side can be displayed equally well. The even distribution is a result of the construction of the bar tack stitch 195 which avoids error in the location of the center of fabric where an inner circumference 165, (which can be defined as either an inner seam or an inner fold) and intersecting seam 185 intersect. The bar tack stitch 195 also conveniently creates a stop for the exposed band 130 during the assembly thereby making assembly easier and more cost effective. Further, the bar tack stitch 195 causes the exposed elastic band 130 to be pushed out from the fabric ring 110, and over both bar tack stitch 195 and inner circumference 165. The bar tack stitch 195 thereby keeps the exposed band 130 accessible to a consumer, negating the need for some other more expensive, difficult, and complicated device, such as a bead, to be attached to the exposed band. Further, such bead is undesirable because, should the bead break or become detached from the exposed elastic band, the elastic band will retract into the fabric ring, making it difficult to retrieve. Additionally, a pair of apertures 140 in accordance with the present invention creates less stress on the fabric than a single aperture because a single aperture requires two elastic loops (one coming out and one going in) to be disposed within a single opening.

As previously noted, the hair accessory depicted in FIG. 1*a* can be made from a single piece of fabric. Such embodiment can desirably provide a reversible scrunchie with the same fabric type color, but different printed matter on opposite sides.

Figure 2:
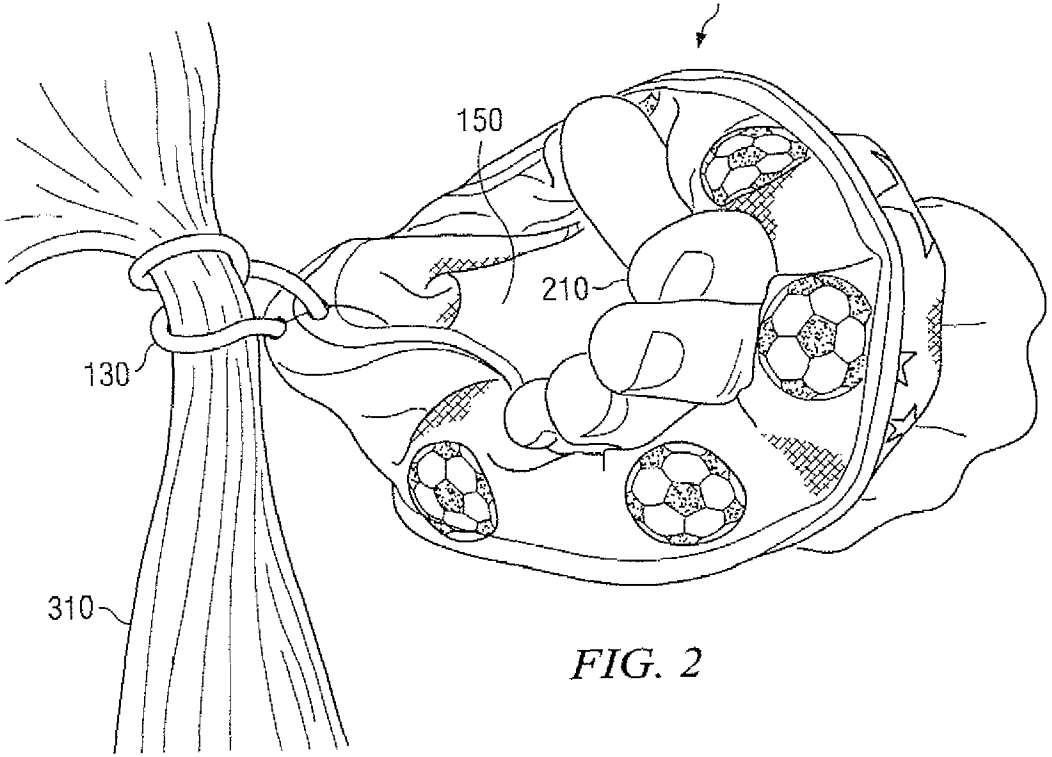
FIG. 2 illustrates one step of preparing the hair accessory depicted in FIG. 1 for placement on a ponytail in accordance with one embodiment of the present invention.

The hair accessory of the present invention can be placed on a ponytail in the following manner. First, the protruding elastic band 130 is pulled away from the fabric ring 110 to form a loop. As the protruding elastic band 130 is pulled, the force or pressure imparted inwardly (concentric pressure) from the elastic band 120 increases and the central opening 150 shrinks. Thus, as more of the protruding band 130 is pulled through the apertures 140, the central opening 150 concomitantly concentrically shrinks. As the protruding elastic band 130 is pulled away from the fabric ring 110, a first loop is formed, a ponytail 310 is placed through the loop, the protruding elastic band 130 is twisted one-half turn, a second loop is formed, and the ponytail 310 is pulled through the second loop. Thus, the elastic band 130 is looped twice around the ponytail 310. The result of this is depicted in FIG. 2. A ponytail 310 can then be inserted through the protruding elastic band 130. The twisting, loop forming, and insertion steps are repeated as desired or until a secure fit has been achieved. One can easily perform the twisting with one hand 210 holding the scrunchie 100 and the other hand holding the ponytail 310. The hand 210 can be used to reach through the loop formed to grab the ponytail 310 and pull it through the elastic band loop 130 and the central opening 150 and securely hold the ponytail 310.

One advantage of the present invention is that the protruding elastic band 130 provides a way to tighten the hold of the pony tail holder 100 without twisting the fabric ring 110 and concentric pressure from both the elastic band 120 within the fabric ring 110 and the exposed elastic band 130 to provide a tight, secure fit. Further, the elastic band 120 within the fabric ring 110 provides significant concentric pressure on any ponytail disposed through the central opening 150. Additionally, as the central opening 150 is expanded to pull the ponytail 310 through, the concentric pressure created by the exposed elastic band 130 on the ponytail 310 increases, creating a more secure fit.

Figure 3A:
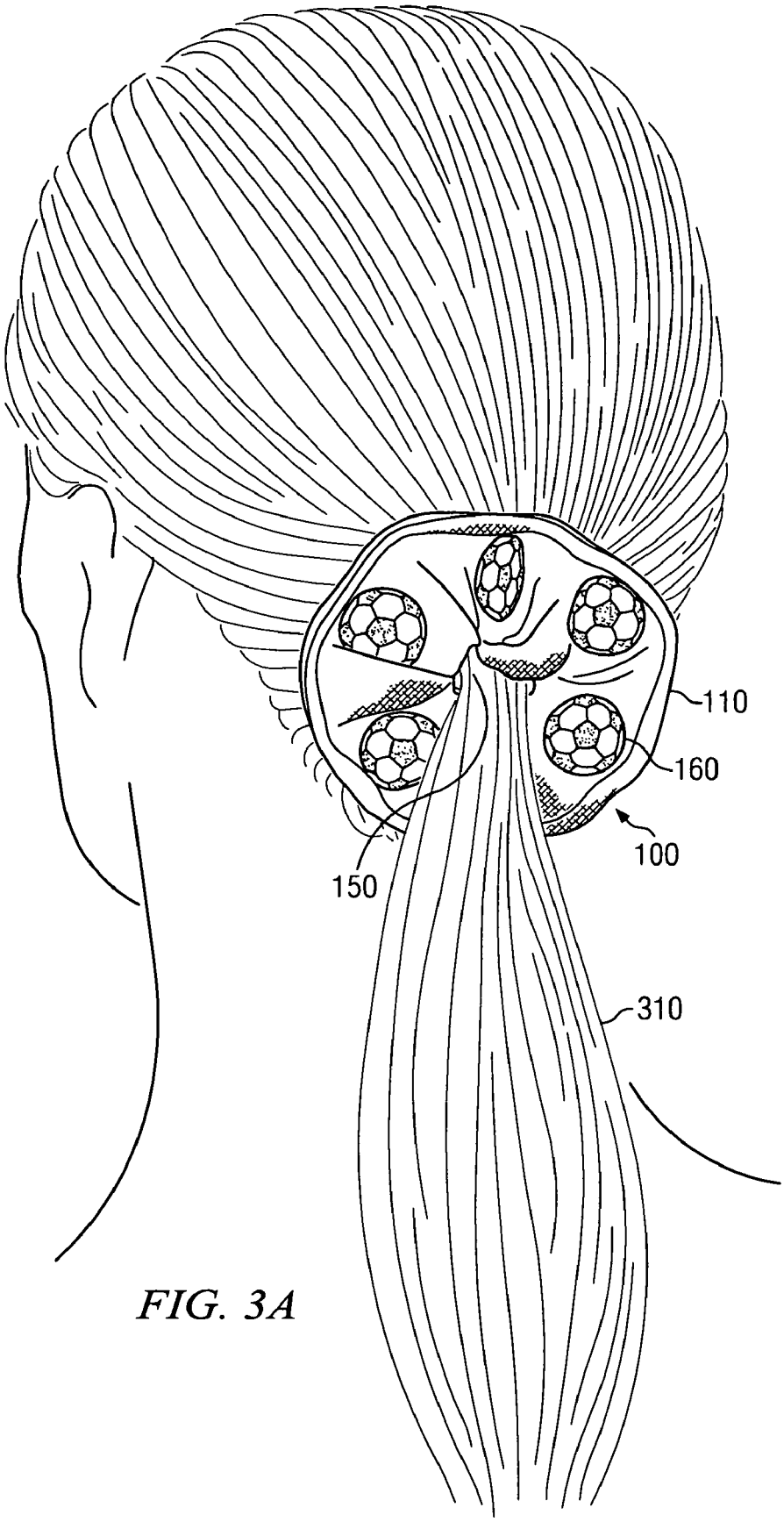
FIG. 3*a* illustrates the hair accessory depicted in FIG. 1 in place on a ponytail in accordance with one embodiment of the present invention.

FIG. 3*a* illustrates the hair accessory depicted in FIG. 1 in place on a pony tail 310 in accordance with one embodiment of the present invention. In this embodiment, the length of hair or ponytail 310 is disposed through the central opening 150. In one embodiment, the length of the elastic band 120 is such that when the band is twisted and placed on a ponytail, the hole in the scrunchie or central opening 150 is reduced to a size that permits the user to both easily place his or her ponytail through the opening 150 while at the same time securing the pony tail holder 100 to the ponytail. As shown in FIG. 3*a*, because the fabric ring 110 is not twisted, there is a clear, unobstructed view of the first design 160 and the second design 170 is obscured from view. In fact, in this embodiment, only the bottom portion of the first design 160 is obscured by the ponytail 310.

If it is desired that the first side be the display side, then the protruding elastic band 130 is pulled towards the second side when the scrunchie is being placed on the ponytail. Similarly, if the second side is to be the display side, the protruding elastic band 130 is pulled towards the first side. For example, in the embodiment depicted in FIG. 2 because the protruding elastic band is pulled toward the side of the fabric ring depicting the soccer balls, the opposite side of the fabric ring 110 or side depicting the stars will be the display side if placed on a ponytail.

As those skilled in the art will recognize, the artwork comprising the first and second designs can be varied and numerous fabrics colors, logos, and depictions can be used. For example, the scrunchie can be used as a billboard and can have the name of a website printed one side and a logo on the other side.

Figure 3B:
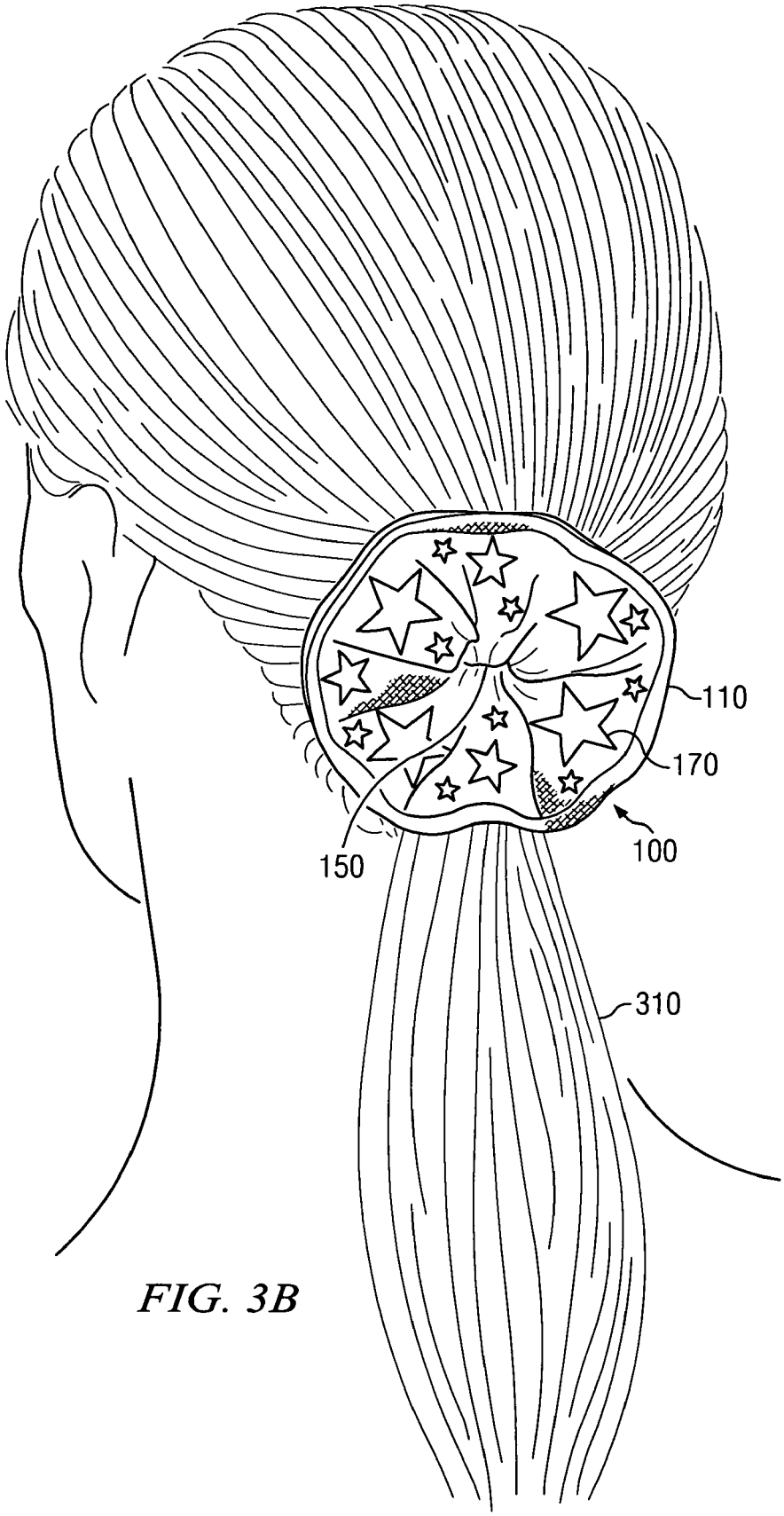
FIG. 3*b* illustrates the hair accessory depicted in FIG. 1 in place on a ponytail in accordance with an alternative embodiment of the present invention.

FIG. 3*b* illustrates the hair accessory depicted in FIG. 1 in place on a ponytail in accordance with the method discussed above with reference to FIG. 2. In this embodiment, pulling of the fabric ring 110 while placing the scrunchie on a ponytail is such that concentric pressure from the elastic band 120 is created that causes central opening 150 to shrink such that there is no longer a visible opening.

In this embodiment, the length of hair or ponytail is not disposed through the central opening 150. Rather, the fabric ring 110 can be placed, for example, above the ponytail 310. Hence, in this embodiment, none of the second design 170 is obscured by the ponytail 310.

The pony tail holder or scrunchie of the instant invention provides several advantages over the prior art. First, it can provide a way to more securely hold the hair than prior art scrunchies by creating concentric pressure. Second, it creates a billboard to display printed artwork on the fabric. Third, because of the novel bar tack stitch, the scrunchie is reversible and is effectively two scrunchies in one. Fourth, because a ponytail can be securely held by the protruding elastic band, actual placement of the ponytail through the central opening is optional. A further advantage of this optional embodiment is that a clear, unobstructed view of the entire first or second side can be achieved as the scrunchie is not even obscured from view by the ponytail 310.

While the invention has been particularly shown and described with reference to a preferred embodiment, it will be understood by those skilled in the art that various changes in form and detail may be made therein without departing from the spirit and scope of the invention.

We claim:

1. A method for making a ponytail holder from two pieces of fabric, said method comprising the steps of:

a) joining a first piece of fabric to a second piece to form an inner seam thereby forming a joined fabric having a first end and a second end wherein said inner seam is located substantially along a longitudinal centerline of said joined fabric;

b) looping said first end through an elastic band and folding said joined fabric in half;

c) joining said first end and said second end together with a stitch, said stitch intersecting said inner seam;

d) pulling said elastic band around said stitch;

e) further joining said first and second ends with an intersecting seam to form a pair of apertures through which said elastic band protrudes; and f) joining a first outer side and a second outer side of said fabric to create an outer seam.

2. The method of claim 1, wherein said first piece of fabric comprises artwork different than said second piece of fabric.

3. The ponytail holder of claim 1 wherein said stitch comprises a bar tack stitch.

4. The ponytail holder of claim 1 wherein said elastic band comprises a seamless loop.

5. The method of making a ponytail holder as claimed in claim 1 wherein said step of further joining said first and second ends comprises the steps:

sewing said intersecting seam starting at a first end of said intersecting seam; jumping a first side of said elastic band, said stitch and a second side of said elastic band; and sewing from said second side of said elastic band to a second end of said intersecting seam.

6. The method of claim 1 further comprising the step placing a line of stitching adjacent to said inner seam for providing a passage for housing said elastic band.

7. A method for making a ponytail holder from a single piece of fabric having a first end and a second end, said method comprising the steps of:

a) looping said first end through an elastic band and folding said fabric in half to create a fold;

b) joining said first end and said second end together with a stitch located substantially on a longitudinal centerilne of said fabric;

c) pulling said elastic band around said stitch;

d) further joining said first and second ends with an intersecting seam to form a pair of apertures through which said elastic band protrudes such that an inner circumference is formed substantially on said longitudinal centerline of said fabric wherein said step of further joining comprises the steps sewing said intersecting seam starting at a first end of said intersecting seam, jumping a first side of said elastic band, said stitch and a second side of said elastic band, and sewing from said second side of said elastic band to a second end of said intersecting seam; and e) joining a first outer side and a second outer side of said fabric to create an outer seam.

8. The method of claim 7, wherein said piece of fabric comprises different artwork on opposite sides of said longitudinal centerline of said fabric.

9. The method of claim 7 further comprising the step placing a line of stitching adjacent to said inner circumference for providing a passage for housing said elastic band.

10. The ponytail holder of claim 7 wherein said stitch comprises a bar tack stitch.

11. The ponytail holder of claim 7 wherein said elastic band comprises a seamless loop.

* * * * *